US011352737B2

(12) United States Patent
Park et al.

(10) Patent No.: US 11,352,737 B2
(45) Date of Patent: Jun. 7, 2022

(54) CLOTHING TREATMENT APPARATUS

(71) Applicant: Samsung Electronics Co., Ltd., Suwon-si (KR)

(72) Inventors: Hyeongjoon Park, Suwon-si (KR); Jaeryong Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 222 days.

(21) Appl. No.: 16/541,598

(22) Filed: Aug. 15, 2019

(65) Prior Publication Data

US 2020/0087848 A1 Mar. 19, 2020

(30) Foreign Application Priority Data

Sep. 14, 2018 (KR) ..... 10-2018-0110493

(51) Int. Cl.

| | |
|---|---|
| ***D06F 73/02*** | (2006.01) |
| ***D06F 58/10*** | (2006.01) |
| ***D06F 58/20*** | (2006.01) |

(52) U.S. Cl.

CPC ..... *D06F 73/02* (2013.01); *D06F 58/10* (2013.01); *D06F 58/203* (2013.01)

(58) Field of Classification Search

CPC ..... D06F 73/02; D06F 58/203; D06F 58/10
See application file for complete search history.

(56) References Cited

U.S. PATENT DOCUMENTS

| | | | | | |
|---|---|---|---|---|---|
| 2,487,175 | A * | 11/1949 | Petre | D06C 5/005 | 223/61 |
| 3,805,561 | A * | 4/1974 | Bullock | D06F 73/02 | 68/5 C |
| 5,094,020 | A * | 3/1992 | Wingfield | D06F 73/02 | 223/51 |
| 5,561,880 | A * | 10/1996 | Allen | D06F 73/02 | 223/51 |
| 5,815,961 | A * | 10/1998 | Estes | D06F 73/02 | 38/14 |
| 6,189,346 | B1 * | 2/2001 | Chen | D06F 73/02 | 68/5 R |
| 6,622,529 | B1 * | 9/2003 | Crane | D06F 43/00 | 68/5 C |
| 6,868,621 | B1 * | 3/2005 | Grimm | D06F 34/26 | 34/92 |
| 8,006,336 | B1 * | 8/2011 | Gerlach | D06F 58/14 | 8/158 |

(Continued)

FOREIGN PATENT DOCUMENTS

| | | | |
|---|---|---|---|
| JP | 2008-188339 | A | 8/2008 |
| KR | 97-23621 | U | 6/1997 |

(Continued)

*Primary Examiner* — Benjamin L Osterhout
(74) *Attorney, Agent, or Firm* — Staas & Halsey LLP

(57) ABSTRACT

A clothing treatment apparatus is provided. The clothing treatment apparatus according to an embodiment includes a body including an accommodation space in which clothing is arranged, a spraying unit disposed in the body, and configured to spray at least one of steam and air toward the clothing, and a door disposed at the body to open and close the accommodation space, wherein a handle member is disposed on an upper surface of the body and a lower surface opposite to the upper surface.

9 Claims, 15 Drawing Sheets

(56) References Cited

U.S. PATENT DOCUMENTS

| | | | | |
|---|---|---|---|---|
| 2002/0154011 | A1* | 10/2002 | Pasin | D06F 73/02 340/540 |
| 2003/0126691 | A1* | 7/2003 | Gerlach | D06F 87/00 8/158 |
| 2004/0163184 | A1* | 8/2004 | Waldron | D06F 73/02 8/149.1 |
| 2005/0120757 | A1* | 6/2005 | Jackson | D06F 73/02 68/5 C |
| 2005/0257440 | A1* | 11/2005 | Seiffert | D06F 73/02 52/79.1 |
| 2009/0255141 | A1* | 10/2009 | Moon | D06F 58/10 34/72 |
| 2010/0282785 | A1* | 11/2010 | Roselle | D06F 58/203 223/61 |
| 2011/0005276 | A1* | 1/2011 | Moon | D06F 73/02 68/6 |
| 2014/0238086 | A1* | 8/2014 | Choi | D06F 58/206 68/20 |

FOREIGN PATENT DOCUMENTS

| | | | |
|---|---|---|---|
| KR | 10-1225504 | B1 | 1/2013 |
| KR | 10-2018-0071313 | A | 6/2018 |
| WO | 2017/070307 | A1 | 4/2017 |

* cited by examiner

CLOTHING TREATMENT APPARATUS

CROSS-REFERENCE TO RELATED APPLICATIONS

This application claims priority from Korean Patent Application No. 10-2018-0110493, filed on Sep. 14, 2018, in the Korean Intellectual Property Office, the disclosure of which is incorporated herein by reference in its entirety.

BACKGROUND

1. Field of the Invention

Devices and methods consistent with what is disclosed herein relate to a clothing treatment apparatus with improved mobility.

2. Description of the Related Art

Generally, a washing machine is used for cleaning fabrics such as clothing or bedding, and the washing machine washes laundry using friction between washing water accommodated in a water tank and laundry. Therefore, separate dehydration and drying process have been necessary.

Recently, a washing machine has been developed to easily clean or manage clothing, and clothing treatment apparatuses for removing wrinkles, or removing dust or odor of clothing without a separate washing process using washing water have been used.

However, a clothing treatment apparatus has a frame module, a draining pipe module, a water tank module, and a door module to form the outer appearance thereof, and thus the height of the clothing treatment apparatus is larger than the width thereof. Accordingly, at least two workers are involved when moving the clothing treatment apparatus, and there is no separate handle at the time of moving, which is inconvenient to move.

SUMMARY

An aspect of the exemplary embodiments relates to providing a clothing treatment apparatus with improved mobility.

According to an exemplary embodiment, there is provided a clothing treatment apparatus including a body including an accommodation space in which clothing is arranged, a spraying unit disposed in the body, and configured to spray at least one of steam and air toward the clothing, and a door disposed at the body to open and close the accommodation space, wherein a handle member is disposed on an upper surface of the body and a lower surface opposite to the upper surface.

The shutter may include a rotational axis connected to an inside of the door, a driving motor connected to one side of the rotational axis, and configured to rotate the rotational axis, and a closing part connected to the rotational axis and configured to close a second inlet based on the rotational axis being rotated.

A shape of the closing part may correspond to a shape of the second inlet, and a sealing member contacting the second inlet may be disposed on a surface of the closing part.

A processor for controlling the driving motor may be further included to allow the second inlet to be opened or closed.

The first inlet and the second inlet may form a main air flow path for connecting an outside to the accommodation space at a short distance, and the processor may control the driving motor to render the shutter to be spaced apart from the main air flow path in an open state.

The processor may control the driving motor to maintain the second inlet to be closed in a closed state.

According to an exemplary embodiment, there is provided a method comprising operating a clothing treatment apparatus including an accommodation space in which clothing is disposed, closing a second inlet to allow a shutter to rotate in a predetermined direction and connect an outside to the accommodation space, and opening the second inlet after the clothing treatment apparatus stops operation, and the shutter rotates in a second direction opposite to the first direction.

The method may further include opening a door of the clothing treatment apparatus after the second inlet is closed, stopping the operation of the clothing treatment apparatus, and opening the second inlet after the shutter rotates in the second direction based on the opened door being closed.

The method may further include re-operating the clothing treatment apparatus and closing the second inlet after the shutter rotates in the first direction.

DETAILED DESCRIPTION OF EXEMPLARY EMBODIMENTS

In order to fully understand the structure and effects of the disclosure, preferable embodiments of the disclosure will be described with reference to the accompanying drawings. The disclosure may, however, be embodied in many different forms and should not be construed as limited to the embodiments set forth herein. It should be understood, however, that the description of the embodiments is provided to enable the disclosure of the disclosure to be complete, and will fully convey the scope of the disclosure to a person having ordinary skill in the art to which the disclosure belongs. In the accompanying drawings, the constituent elements are enlarged in size for convenience of explanation and the proportions of the constituent elements can be exaggerated or reduced.

It will be understood that when an element is referred to as being "on" or connected to" another element, it can be directly connected to the other element or intervening elements may also be present. In contrast, when an element is referred to as being "directly on" or "directly connected to" another element, no intervening elements are present. Meanwhile, other expressions describing relationships between components such as "~ between" and "directly adjacent to ~" may be construed similarly.

The terms such as "first," "second," and so on may be used to describe a variety of elements, but the elements should not be limited by these terms. The terms are used simply to distinguish one element from other elements. The use of such ordinal numbers should not be construed as limiting the meaning of the term. For example, without departing from the scope of the disclosure, the first component may be referred to as a second component, and similarly, the second component may also be referred to as a first component.

The singular expression also includes the plural meaning as long as it does not differently mean in the context. In this specification, terms such as 'include' and 'have/has' should be construed as designating that there are such characteristics, numbers, operations, elements, components or a combination thereof in the specification, not to exclude the existence or possibility of adding one or more of other characteristics, numbers, operations, elements, components or a combination thereof.

Unless otherwise defined, all terms (including technical and scientific terms) used herein have the same meaning as commonly understood by one of ordinary skill in the art to which this disclosure belongs.

Figure 1:
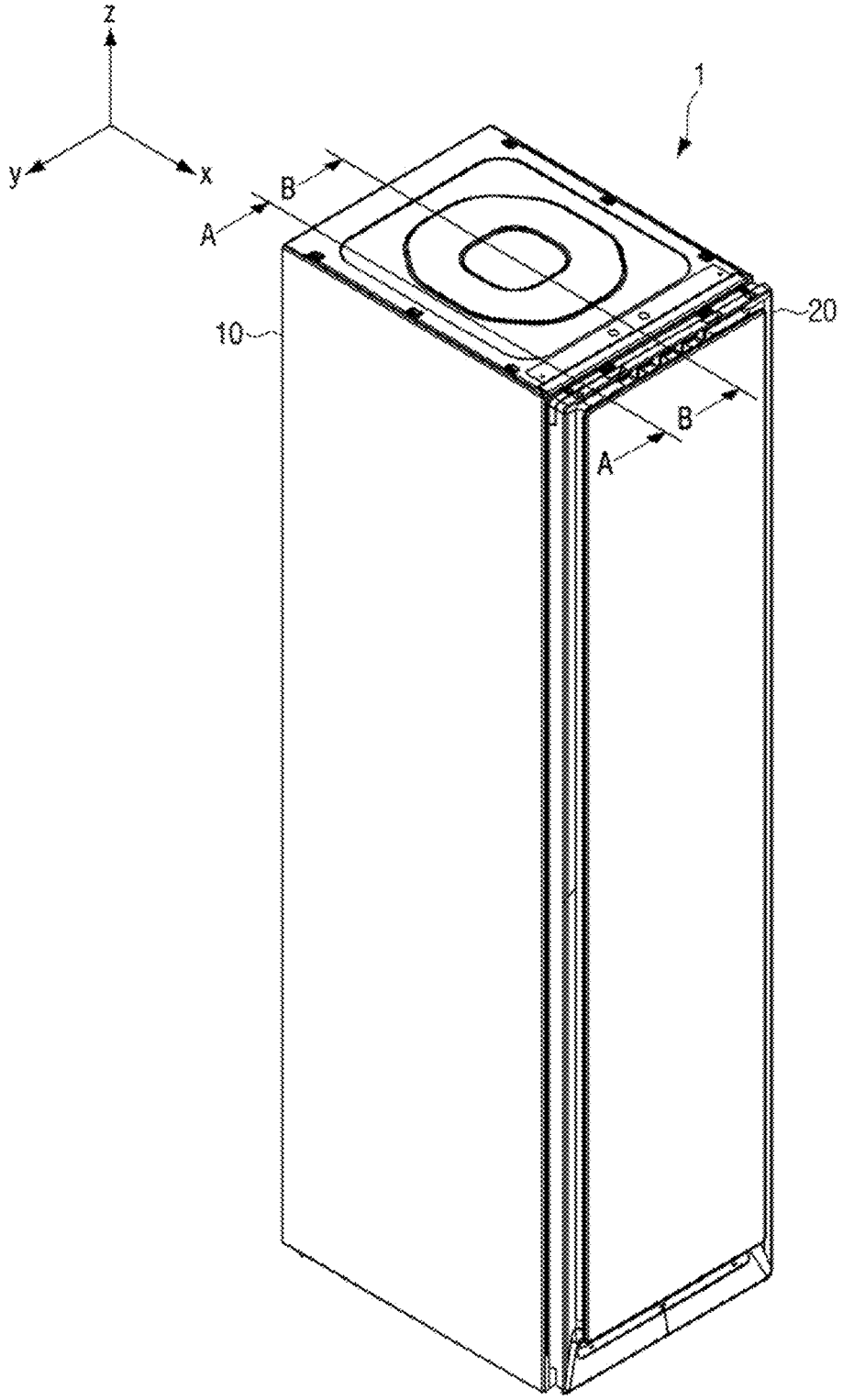
FIG. 1 is a perspective view illustrating a clothing treatment apparatus according to an embodiment of the disclosure.
Figure 2:
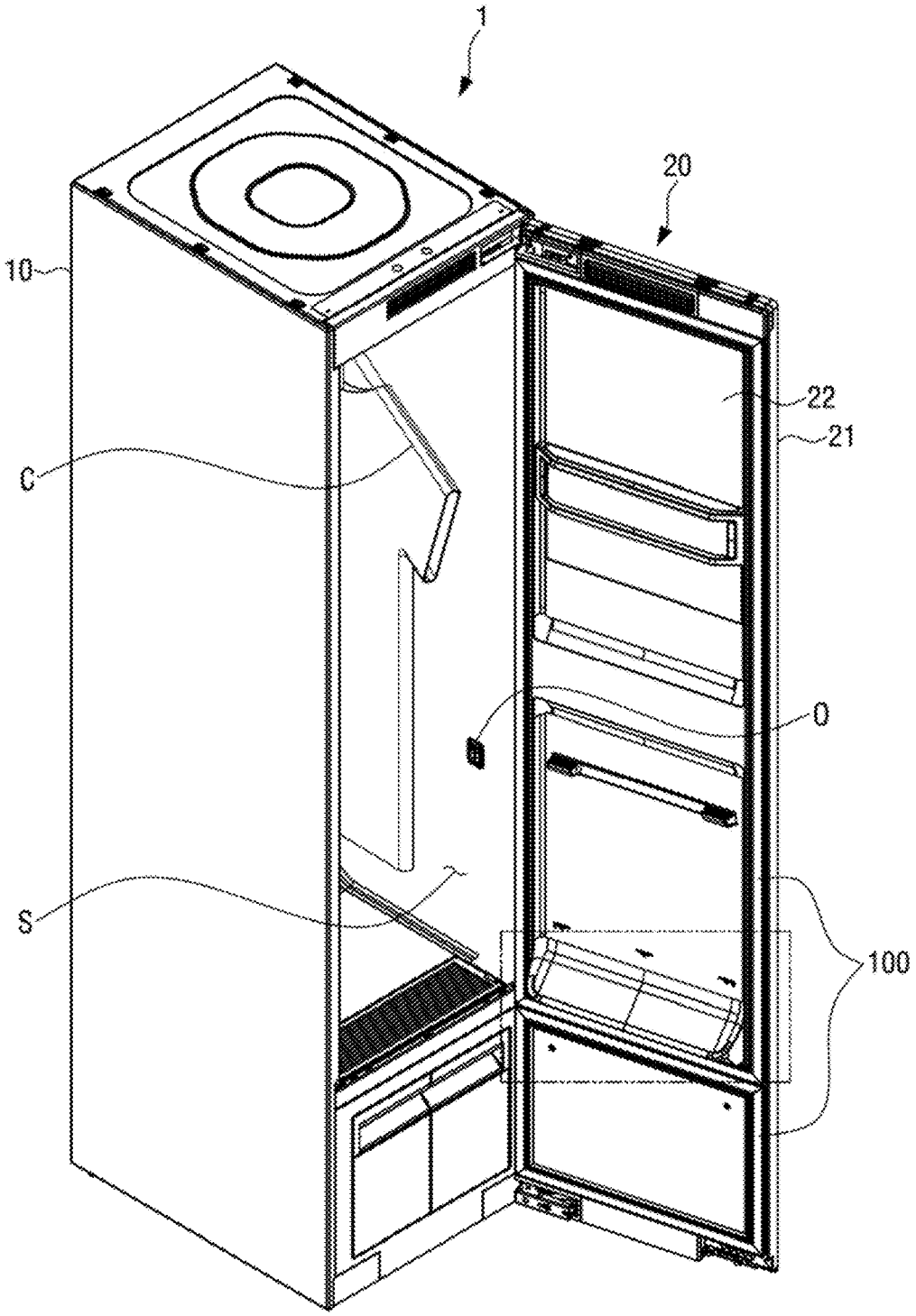
FIG. 2 is a perspective view illustrating a clothing treatment apparatus with door open.
Figure 3:
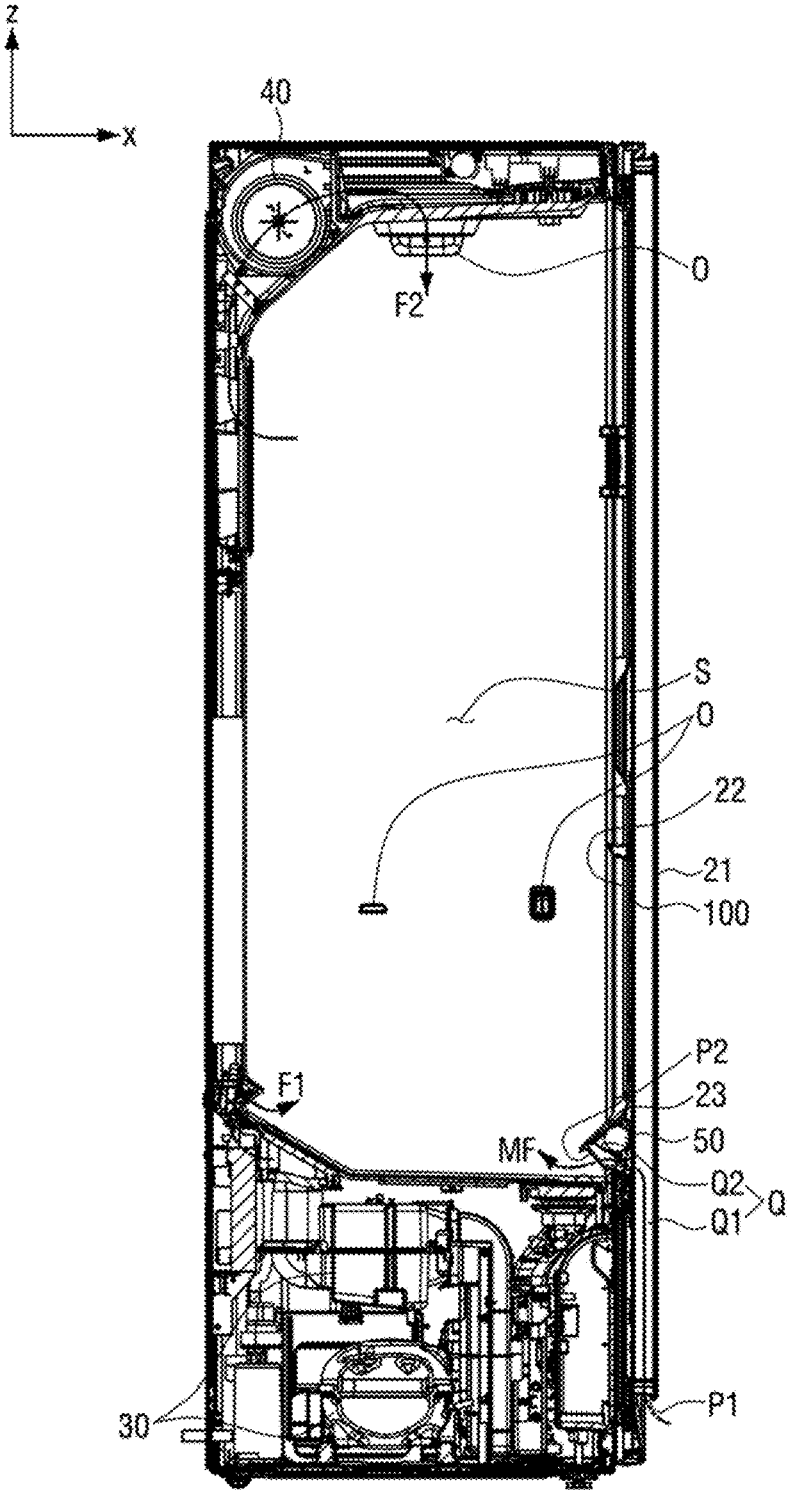
FIG. 3 is a cross-sectional view taken along A-A of FIG. 1.

FIG. 1 is a perspective view illustrating a clothing treatment apparatus 1 according to an embodiment of the disclosure, FIG. 2 is a perspective view illustrating a clothing treatment apparatus 1 with door 20 open, and FIG. 3 is a cross-sectional view taken along A-A of FIG. 1.

Referring to FIG. 1 and FIG. 2, a clothing treatment apparatus 1 may include a body 10 including an accommodation space S therein, and a door 20 pivotably coupled to the body.

The body 10 may form the outer appearance of the clothing treatment apparatus 1, the accommodation space S in which clothing C is arranged may be provided. The clothing treatment apparatus 1 may include a spraying unit 30 under the accommodation space S in which clothing C is arranged, a plurality of spraying holes O disposed toward the accommodation space S to allow air or steam discharged from the spraying unit 30 to be sprayed, and a circulation fan 40 for inhaling outside air and circulating air or steam discharged from the spraying unit 30 into the accommodation space S.

The accommodation space S may be formed as big as to arrange the clothing C in the body 10, and the shape thereof may vary to the extent necessary.

The accommodation space S may be sealed from the outside, except for the plurality of spraying holes O when the clothing treatment apparatus 1 operates. Therefore, the clothing C disposed in the accommodation space S may be ironed by air or steam sprayed from the plurality of spraying holes O in the closed space, and also the odor of the clothing C may be deodorized.

Referring to FIG. 3, the spraying unit 30 may be disposed in the body 10, and may spray at least one of steam or air toward the clothing C.

The spraying unit 30 may inhale air flowing from the outside, or air the accommodation space S, dehumidify or heat the inhaled air selectively, and spray the air into the accommodation space S in which the clothing C is arranged.

The spraying unit 30 may not only dehumidify or heat the inhaled air, but also combine the air with hot water vapor to be sprayed in the form of steam into the accommodation space S in which the clothing C is arranged.

The spraying unit 30 may spray air in various states to the accommodation space S according to the user's selection for treatment of the clothing C.

The plurality of spraying holes O may be disposed on each of upper, lower, left, and right sides of the accommodation space S, and may spray the air formed in the spraying unit 30 toward the clothing C arranged in the accommodation space S.

The plurality of spraying holes may be disposed in different positions in the accommodation space S according to selection.

The circulation fan 40 may be disposed on a path in which air flows from the spraying unit 30 to the accommodation space S, and may move the air discharged from the spraying unit 30 to the plurality of spraying hole O disposed in the accommodation space S.

The circulation fan 40 may inhale or discharge outside air into the clothing treatment apparatus 1, or circulate whole air of the clothing treatment apparatus 1.

FIG. 3 illustrates that the circulation fan 40 is an axial fan but, to the extent necessary, various types of fans may be used.

Referring to FIG. 2, the door 20 may be provided in the body 10 to close or open the accommodation space S.

The door 20 may form one surface of the outer appearance of the clothing treatment apparatus 1, and distinguish the outside of the clothing treatment apparatus 1 from the accommodation space S.

The door 20 may include a front plate 21 and a rear plate 22 disposed on the rear surface of the front plate 21.

A display (not shown) for controlling the operation of the clothing treatment apparatus 1, or the state of the clothing treatment apparatus 1 by a user may be disposed on the front plate 21.

The rear plate 22 may cover one side surface of the body 10, and a cross-section thereof will be greater than that of the front plate 21.

The rear plate 22 may be formed to be spaced apart from the front plate 21 at a preset distance so that outside air may be introduced along the edge of the front plate 21.

A main air flow path MF into which outside air flows, and a first inlet P1, which is an inlet of the main air flow path MF, may be formed between the rear plate 22 and the front plate 21.

A gasket 100 contacting the edge of the body 10 may be disposed on the edge of the rear surface of the rear plate 22. Accordingly, the rear plate 22 may be disposed on one side surface of the body 10 to seal the inside of the body 10.

A cover 23 coupled to one surface of the rear plate 22 may be included in one surface of the rear plate 22 to form the main air flow path MF, and an arrangement space (Q) in which the shutter 50 is arranged.

The cover 23 may protrude toward the accommodation space S, and accordingly, the shutter 50 for selectively opening and closing a second inlet P2 may be disposed in the cover 23.

The door 20 may include the first inlet P1 connected to the outside, the second inlet P2 connecting the first inlet P1 to the accommodation space S, and the shutter 50 for selectively opening or closing the second inlet P2.

The first inlet P1 may be formed between the front plate 21 and the rear plate 22 along the edge of the door 20, and may form the entry of the main air flow path MF into which outside air is flows.

It is illustrated that the first inlet P1 is formed under the door 20, but is not limited thereto, but may be formed in various shapes in various positions.

The second inlet P2 may form the exit of the main air flow path MF, and connect the main air flow path MF to the accommodation space S. When outside air flows into the inside of the clothing treatment apparatus 1, the outside air may flow into the accommodation space S through the first inlet P1, the main air flow path MF, and the second inlet P2.

The first inlet P1 and the second inlet P2 may form the main air flow path MF connecting the outside of the clothing treatment apparatus 1 to the accommodation space S at a short distance.

Therefore, although a user is in the clothing treatment apparatus 1 when the clothing treatment apparatus 1 is not operated, the user may be prevented from being suffocated thanks to the structure in which the accommodation space S is connected to the outside.

Referring to FIG. 3, the main air flow path MF for connecting the outside of the clothing treatment apparatus 1 to the accommodation S of the clothing treatment apparatus 1 may be formed through the arrangement space Q between the front plate 21 and the rear plate 22 of the door 20.

The main air flow path MF may be formed through a first space G1 between the rear plate 22 and the front plate 21, and a second space G2 between the rear plate 22 and the cover 23.

The arrangement space Q may be the same as the second space G2.

The air introduced from the outside and inhaled in the accommodation space S may be converted into air in a state required by a user through the spraying unit 30.

The converted air may be sprayed into the accommodation space S along first and second circulation flow paths F1 and F2 by the circulation fan 40 disposed on the first and second circulation flow paths F1 and F2.

The first and second circulations flow paths F1 and F2 may be paths in which air flows when the clothing treatment apparatus 1 operates, and the main air flow path MF may be a path in which outside air moves to the accommodation space S when the clothing treatment apparatus is not operated.

The first circulation flow path F1 may be a path through which the high-temperature steam, which is converted in the spraying unit 30, is discharged, and the second circulation flow path F2 may be a path for spraying the air inhaled in the accommodation space S toward the clothing C, so that the dust of the clothing C may be removed.

The first and second circulation flow paths F1 and F2 may be embodies as various paths, and air flowing through the first and second circulation flow paths F1 and F2 may be in various states.

Figure 4:
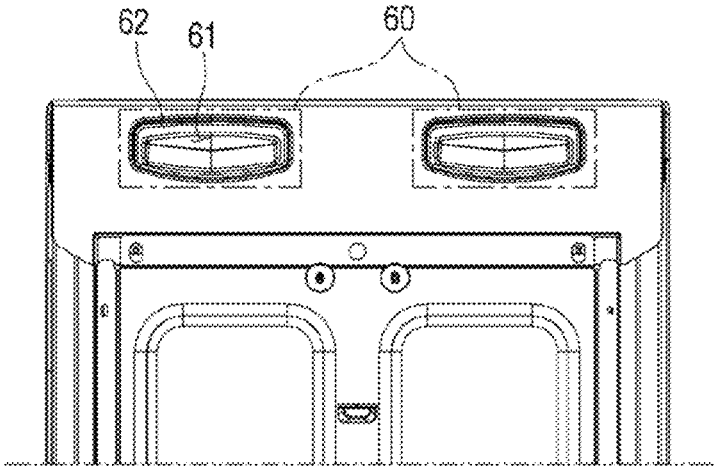
FIG. 4 is a rear view illustrating a rear upper side of the clothing treatment apparatus.

FIG. 4 is a rear view illustrating a rear upper side of the clothing treatment apparatus 1.

At least one handle area 60 may be formed on the upper rear surface of the clothing treatment apparatus 1. The handle area 60 may include a groove 61 in a preset depth from the rear surface of the clothing treatment apparatus 1.

A fixing member 62 for placing hands may be disposed near the groove 61.

Accordingly, when moving the clothing treatment apparatus 1, the user may move the clothing treatment apparatus 1 with holding the fixing member 62 fixed to the handle area 60. Therefore, the user may easily move the clothing treatment apparatus 1, and the risk for breakage or deformation of the clothing treatment apparatus 1 may be reduced.

It is illustrated the handle area 60 and the fixing member 62 formed in the handle area 60 may be disposed on the upper rear surface of the clothing treatment apparatus 1, but could be disposed in different positions of the clothing treatment apparatus 1.

It is illustrated that the fixing member 62 formed in the handle area 60 is disposed on the upper rear surface. However, to the extent necessary, the handle member 70 may be fixedly disposed.

Figure 5:
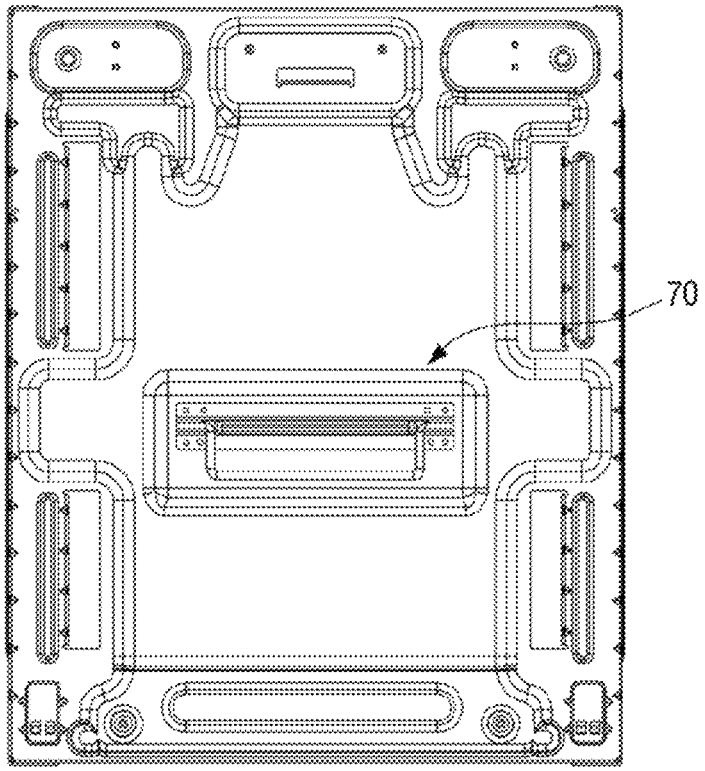
FIG. 5 is a bottom view illustrating a clothing treatment apparatus.
Figure 6:
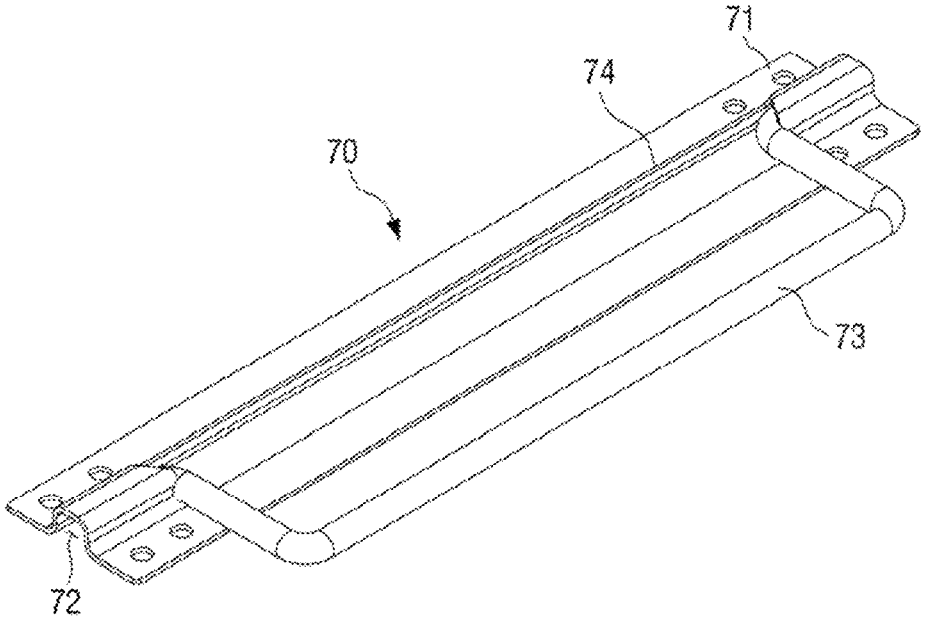
FIG. 6 is a perspective view illustrating a handle member according to an embodiment of the disclosure.
Figure 7:
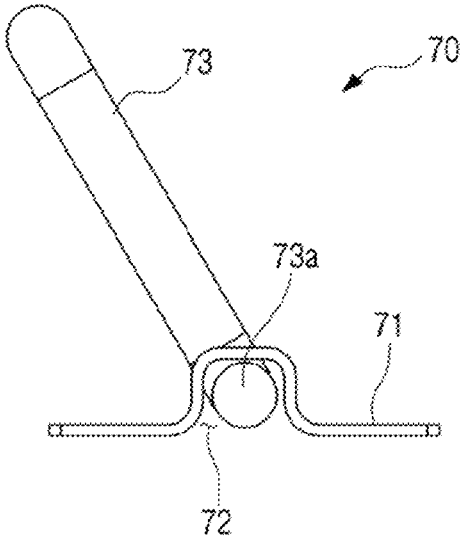
FIG. 7 is a side view illustrating a handle member according to an embodiment of the disclosure.

FIG. 5 is a bottom view illustrating a clothing treatment apparatus 1, FIG. 6 is a perspective view illustrating a handle member 70 according to an embodiment of the disclosure, and FIG. 7 is a side view illustrating a handle member 70 according to an embodiment of the disclosure.

The handle member 70 may be disposed on the bottom surface of the clothing treatment apparatus 1.

The handle member 70 may include a fixing part 71 fixed to the outer surface of the clothing treatment apparatus 1, accommodation parts 72 formed on both ends of the fixing part 71, and a ring member 73 including insert parts 73*a* inserted into the accommodation parts 72.

The fixing part 71 may be formed of a flat plate to be closed and fixed to the outer surface of the clothing treatment apparatus 1.

The fixing part 71 may be stably fixed to the outer surface of the clothing treatment apparatus 1 by an additional coupling member such as screw, etc.

Fixing openings formed on the edge areas of the fixing part 71 and into which coupling members are inserted may be disposed asymmetrically to give approximate coupling positions.

For example, the positions or sizes of the fixing openings disposed on the upper side and the lower side may vary with respect to the accommodation parts 72 formed in the center portion of the fixing part 71.

In addition, the spaces of the fixing openings disposed on the upper side and the lower side may be different with respect to the accommodation parts 72 formed in the center portion of the fixing part 71.

The accommodation parts 72 may be formed in the form of opening on both ends of the fixing part 71, and the insert parts 73*a* formed on both ends of the ring member 73 may be inserted to be respectively rotatable.

The ring member 73 may rotate based on the insert parts 73*a* of both ends.

The insert parts 73*a* may have at least one uneven surface, not a circular-shaped surface. Accordingly, the uneven surface may be interfered with the inner surface of the accommodation parts 72 to limit the radius of rotation of the ring member 73.

The ring member 73 may have various shapes to be coupled to the fixing part 71 and held by a user.

An interfering part 74 for limiting the radius of rotation of the ring member 73 may be formed on one surface of the fixing part 71.

The interfering part 74 may contact one surface of the ring member 73 and limit the radius of rotation of the ring member 73, and when a user holds the ring member 73, it may be prevented that a hand is caught between the ring member 73 and the outer surface of the clothing treatment apparatus 1.

Figure 8:
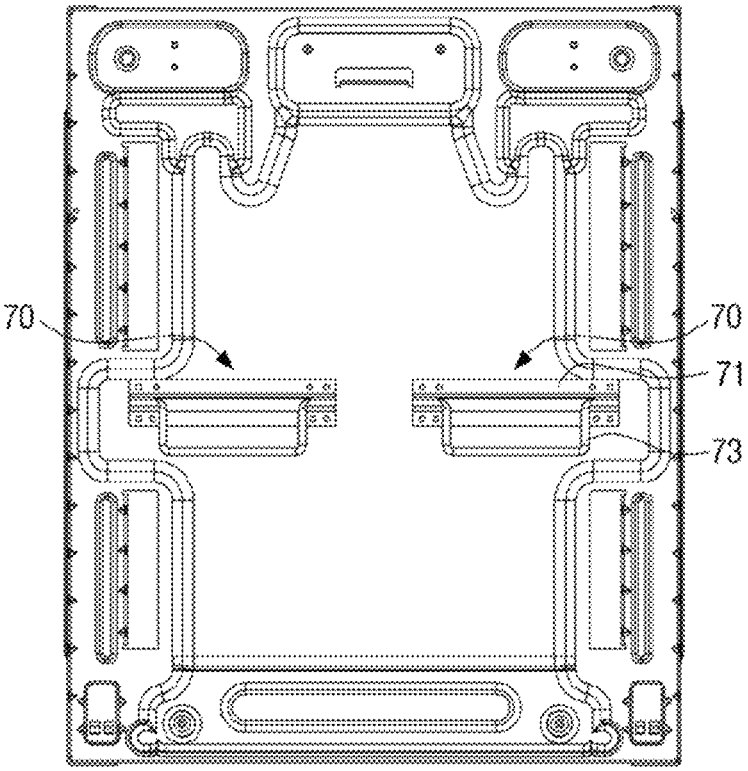
FIG. 8 is a bottom view illustrating a clothing treatment apparatus according to another embodiment of the disclosure.
Figure 9:
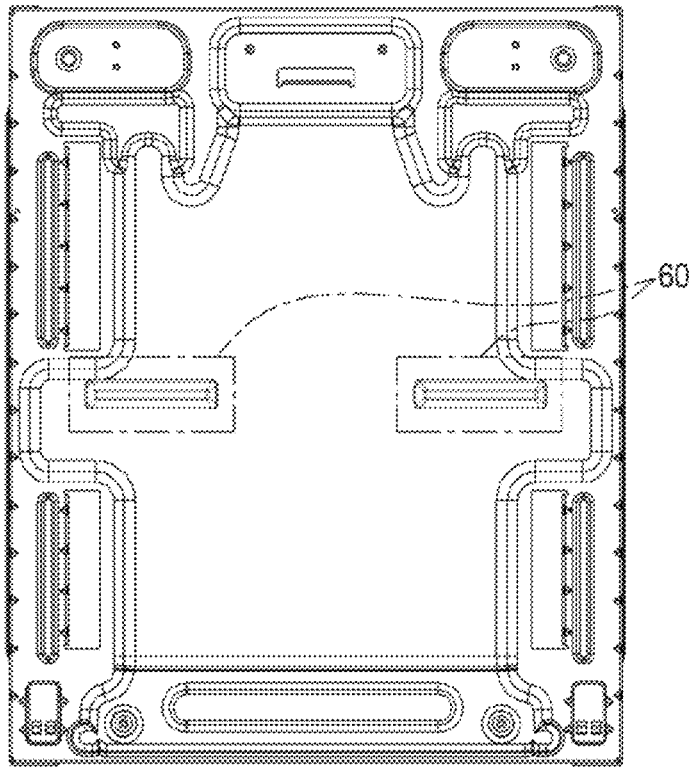
FIG. 9 is bottom view illustrating a clothing treatment apparatus according to yet another embodiment of the disclosure.

FIG. 8 is a bottom view illustrating a clothing treatment apparatus according to another embodiment of the disclosure, and FIG. 9 is bottom view illustrating a clothing treatment apparatus according to yet another embodiment of the disclosure.

The ring member 73 and the fixing part 71 may be disposed on the bottom of the clothing treatment apparatus 1 at a predetermined distance. Even when the spraying unit 30 with greater weight is disposed on the bottom of the clothing treatment apparatus 1, the clothing treatment apparatus 1 may stably move.

Figure 10:
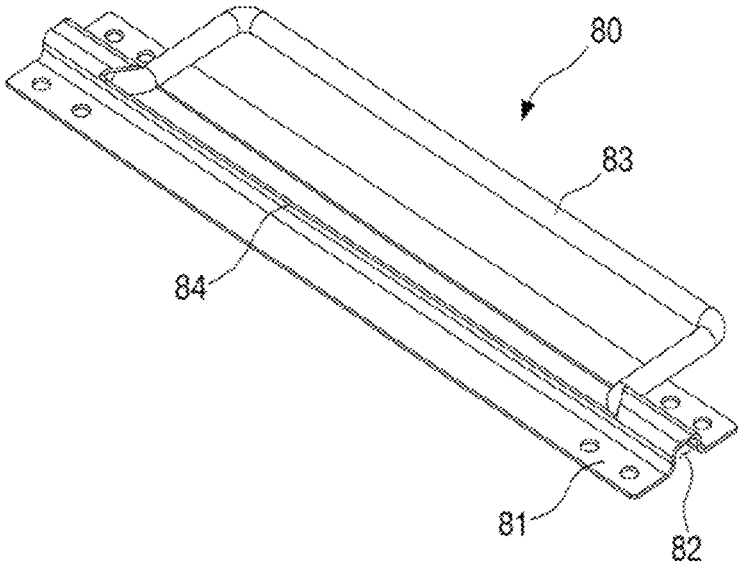
FIG. 10 is a perspective view illustrating a handle member according to a deformation embodiment of the disclosure.
Figure 11:
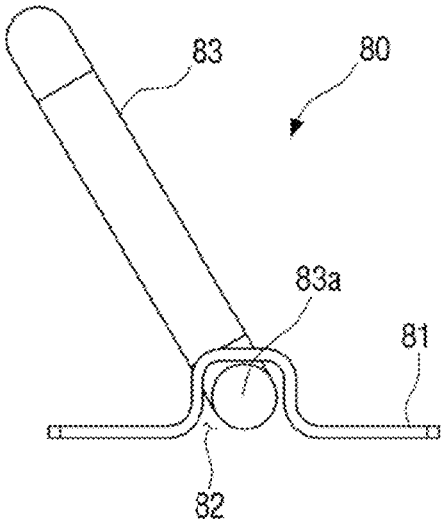
FIG. 11 is a side view illustrating a handle member according to a deformation embodiment of the disclosure.

FIG. 10 is a perspective view illustrating a handle member 80 according to a deformation embodiment of the disclosure, and FIG. 11 is a side view illustrating a handle member 80 according to a deformation embodiment of the disclosure.

A cover interfering surface 84 for connecting accommodation parts 82 formed on both ends along the length direction of the fixing part 81 may be formed.

The cover interfering surface 84 may be interfered with one side of the ring member 83 connected to the fixing part 81 to limit the radius of rotation of the ring member 83. When the user holds the ring member 83, it may be prevented from that a hand is caught between the ring member 83 and the outer surface of the clothing treatment apparatus 1.

The cover interfering surface 84 may prevent contaminants of the outside from flowing between the ring member 83 and the fixing part 81, so that the durability of the ring member 83 may be improved.

Accordingly, the user may easily move the heavy clothing treatment apparatus 1 through the ring member 83 and the fixing member 82, and the breakage and the deformation of the clothing treatment apparatus 1 may be reduced.

Referring to FIG. 12, FIG. 13, FIG. 14, and FIG. 15, exemplary figures of the handle member 70 will be explained.

FIG. 12, FIG. 13, FIG. 14, and FIG. 5 are views illustrating a numerical value of a handle according to an embodiment.

Figure 12:
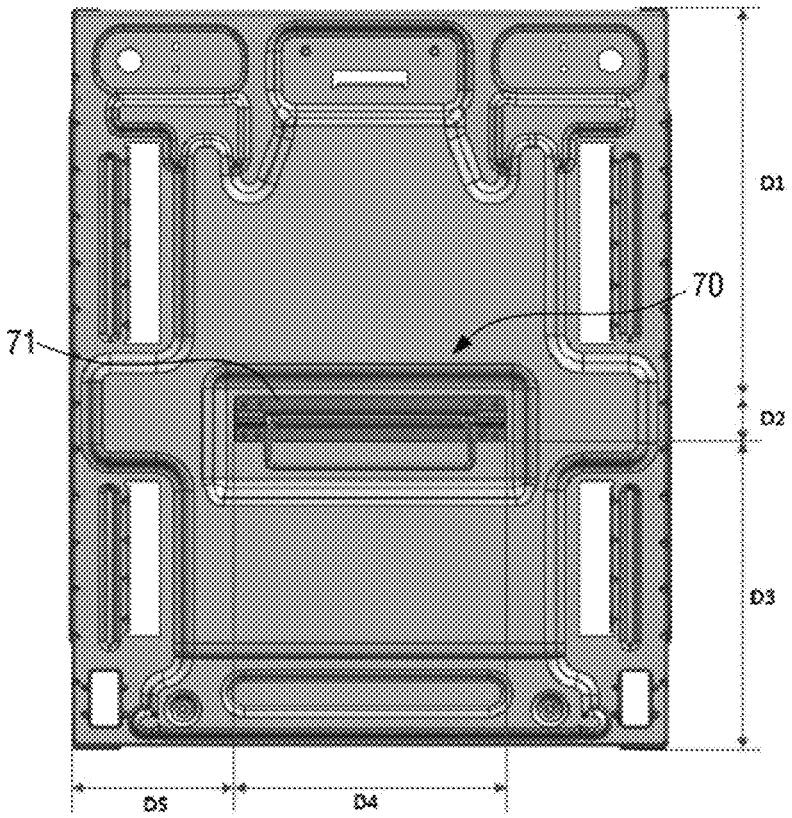
FIG. 12, FIG. 13, FIG. 14, and FIG. 15 are views illustrating a numerical value of a handle according to an embodiment.

Referring to FIG. 12, the fixing part 71 of the handle member 70 may have a first length D4 in a horizontal greater than a second length D2 in a vertical direction. Accordingly, the weight applied to the ring shape formed long in the horizontal direction may be dispersed stably.

For example, the first length D4 may be 198 mm, and the second length D2 may be 33.2 mm.

The handle member 70 including the fixing part 71 may be disposed at the center of the bottom of the clothing treatment apparatus 1. Accordingly, the handle member 70 may support the center of gravity of the clothing treatment apparatus 1 to be moved stably.

For example, the fixing part 71 may be disposed to be spaced apart from the both vertical surfaces of the bottom at a third length D5, and the length of the clothing treatment apparatus 1 may be the sum of the first length D4 and two third lengths D5.

The third length D5 may be 119.65 mm.

The fixing part 71 may be disposed to be spaced from a fourth length D1 and a fifth length D3 from both horizontal surfaces of the bottom of the clothing treatment apparatus 1.

For example, high load may be applied to the position where a water tank is disposed in the spraying unit 30 of the clothing treatment apparatus 1, and the fixing part 71 may be disposed in a vertical direction.

Accordingly, the handle member 70 may more stably move considering the center of gravity of the bottom of the clothing treatment apparatus 1.

The vertical length of the clothing treatment apparatus 1 may be the sum of the fourth length D1, the fifth length D4, and the second length D2.

Figure 13:
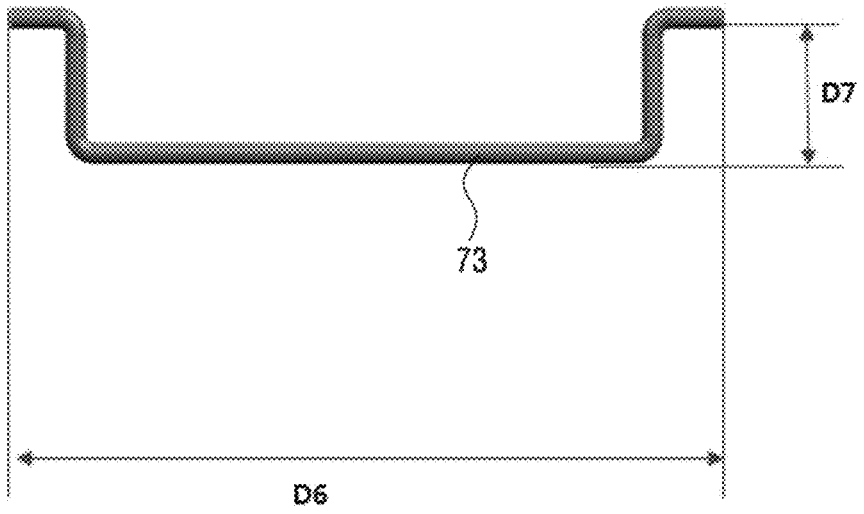
Figure 15:
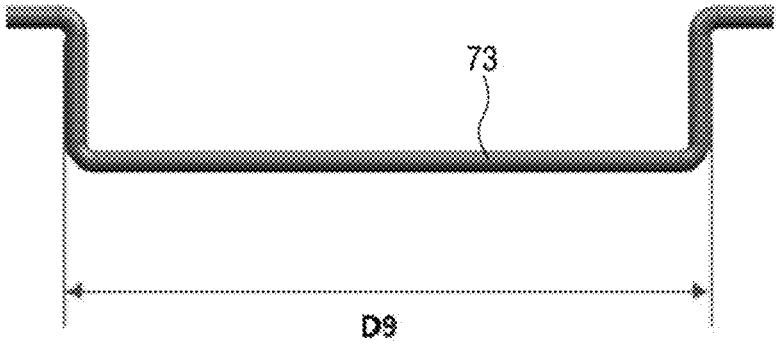

Referring to FIG. 13, and FIG. 15, the ring member 73 may form a seventh length D9, which is the handle of a sixth length D6 as an entire horizontal length, and may be curved toward one direction from the both ends of the handle.

For example, the sixth length D6 may be 185 mm, and the seventh length D9 may be 155 mm.

The ring shape may form an eighth length D7, which is the entire vertical length, and may be curved toward one side from the both ends in which the eighth length D7 is formed.

For example, the eight length D7 may be 40.5 mm.

Figure 14:
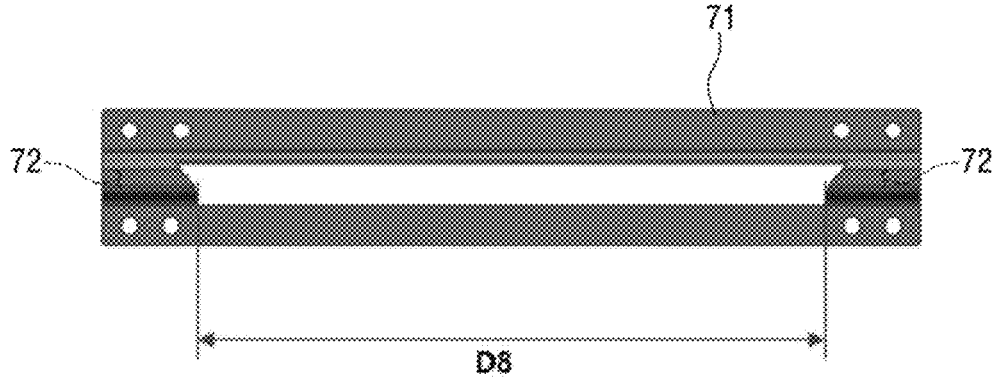

Referring to FIG. 14, the distance between the accommodation parts 72 formed on both ends of the fixing part 71 may be a ninth length D8. To be specific, the shortest distance between the inclined surfaces formed inwardly from respective accommodation parts 72 may be the ninth length D8.

For example, the night length D8 may be 152.7 mm.

Accordingly, the ring shape may be interfered with the inclined surface or the interfering surface formed in the accommodation parts 72 so that the radius of rotation may be limited.

Radius of rotation may be the maximum angle between the bottom and the position with which the ring member 73 is interfered, which is 120 degrees.

While the disclosure has been described with reference to exemplary embodiments, it is to be understood that the embodiments are not necessarily implemented alone, but the configuration and operation of each embodiment may be implemented in combination with at least one other embodiment.

Although exemplary embodiments have been shown and described, it will be appreciated by those skilled in the art that changes may be made to these exemplary embodiments without departing from the principles and spirit of the disclosure. Accordingly, the scope of the present disclosure is not construed as being limited to the described exemplary embodiments, but is defined by the appended claims as well as equivalents thereto.

What is claimed is:

1. A clothing treatment apparatus, comprising:

body including an accommodation space in which clothing is arranged;

a spraying unit disposed in the body, and configured to spray at least one of steam and air toward the clothing;

a door disposed at the body to open and close the accommodation space; and handle members disposed on an upper surface of the body and a lower surface opposite to the upper surface, wherein each of the handle members includes:

a fixing part formed of a flat plate and fixed to the upper surface or the lower surface of the body, the fixing part including a top end, a bottom end, a left end, and a right end;

accommodation parts formed at the left end and the right end of the fixing part, protruding from the fixing part, and including an opening; and a ring member including insert parts rotatably inserted into the accommodation parts.

2. The clothing treatment apparatus as claimed in claim 1, wherein the fixing part is closely attached to be fixed on an outer surface of the body by a coupling member and includes a fixing opening into which the coupling member is inserted, and asymmetrically disposed.

3. The clothing treatment apparatus as claimed in claim 1, wherein the insert parts include an uneven surface interfered with an internal surface of the accommodation parts.

4. The clothing treatment apparatus as claimed in claim 1, wherein the fixing part includes a cover interfering surface which is interfered with one side of the ring member to limit a radius of rotation of the ring member.

5. The clothing treatment apparatus as claimed in claim 4, wherein the cover interfering surface connects the accommodation parts formed at the left end and the right end of the fixing part.

6. The clothing treatment apparatus as claimed in claim 1, wherein a first length in a horizontal direction of the fixing part is longer than a second length in a vertical direction of the fixing part.

7. The clothing treatment apparatus as claimed in claim 1, wherein the handle members are disposed at a center of gravity of the lower surface of the body.

8. The clothing treatment apparatus as claimed in claim 1, wherein the ring member is formed to be curved toward one direction from left and right ends of a handle.

9. The clothing treatment apparatus as claimed in claim 1 wherein the door comprises:

a first inlet connected to an outside;

a second inlet configured to connect the first inlet to the accommodation space; and a shutter configured to selectively open and close the second inlet.

* * * * *